United States Patent [19]

Kubota et al.

[11] Patent Number: 4,673,232

[45] Date of Patent: Jun. 16, 1987

[54] PUSH-IN TERMINAL SYSTEM

[75] Inventors: Teruo Kubota; Takashi Tasaki, both of Utsunomiya, Japan

[73] Assignee: Yamato Denki Co., Ltd., Tokyo, Japan

[21] Appl. No.: 814,955

[22] Filed: Dec. 31, 1985

[51] Int. Cl.[4] ..... H01R 4/24

[52] U.S. Cl. ..... 439/441; 439/393

[58] Field of Search ..... 339/95 D

[56] References Cited

U.S. PATENT DOCUMENTS 3,138,421 6/1964 Locker et al. ..... 339/95 D 3,167,252 1/1965 Smith ..... 339/95 D

*Primary Examiner*—Joseph H. McGlynn

*Attorney, Agent, or Firm*—David H. Semmes; Warren E. Olsen

[57] ABSTRACT

The present invention is for providing the terminal system, wherein, by employing a piece of metallic spring material, the portion which exclusively takes charge of mechanical connection and the portion which exclusively takes charge of electric contact are independently formed on the piece, in other words, the portion taking charge of mechanical connection does not consider the electric contact and the portion taking charge of electric contact does not consider the mechanical connection, therefore, since each portion can fully exert each function, the superiority in mechanical connection and electric contact is obtained.

5 Claims, 12 Drawing Figures

PUSH-IN TERMINAL SYSTEM

BACKGROUND OF THE INVENTION

The present invention relates to a terminal system, mainly provided in electric wiring instruments used in home, which is used to connect a cable when the above instruments such as a plug, a plug receptacle, ceilings and a switch, are newly provided, and added or replaced. The present terminal system does not require screws for attachment, therefore, a man with no expert knowledge of electricity can easily and safely connect the above described instrument with the cable, by simply inserting the cable into the hole without a tool.

Prior Art

With regard to the terminal system which connects the cable by this kind of easy means, many inventions have been proposed, and some of them are sent to markets, and it is almost common basic principle that a spring is provided in the above described terminal system in order to connect and fix the cable by pressure.

The terminal system shown in FIG. 9 is a conventional example. In this system, a plate having superiority in spring force and in conductivity, such as phosphor bronze and brass, is used. The retaining portions 10A and 10B of the connector 10 are formed by pressure so that a gap may exist at the side to which the cable 30 is inserted at one side and the two plates may closely contact at the other side. When the cable 30 is inserted from the shown side of the above described retaining portions 10A and 10B, namely, from the gap side, the cable can be inserted against relatively small mechanical resistance. When the cable is pulled, due to the interaction of the spring force induced by said retaining portions 10A and 10B and the shapes of said retaining portions 10A and 10B, a large resistance against the pulling load is induced, and this ensures the connection of the above cable 30. The difference of the mechanical resistance between inserting and pulling as shown in FIG. 10, is generated from the interaction of the angle $\beta$, between the retaining portions 10A, 10B and the cable 30, and the spring force from the above retaining portions 10A and 10B, pressing the cable 30. In the range of angle being less than 45°, the relationship between the angle $\beta$ and the mechanical resistance difference between inserting and pulling, is proportional. In the extreme case, when the angle $\beta$ is zero, in other words, both of said retaining portions 10A and 10B are formed in parallel with the cable 30, this means that the resistance difference between inserting and pulling becomes zero. In this case, inserting and pulling the cable 30 can be done with same force. The above explanation, at the same time, means the following relationship. Namely, when the contact area, between said cable 30 and said retaining portions 10A and 10B, is increased so as to send the large current, the above angle $\beta$ becomes zero and the function to retain the cable 30 is decreased, on the contrary, when the angle $\beta$ is increased to enhance the function to retain the cable 30, the above described contact area becomes a point, and the allowable current is reduced.

Through the above reasons, this kind of conventional terminal system, in order to endure the load of pulling cable considered to be induced in usual use, necessarily requires the angle, between the cable 30 and the above retaining portions 10A and 10B, to be more than fixed value, therefore, the above contact area becomes small. As a result, it can be said that this kind of conventional terminal system is not suitable to large current cable connection.

The problem explained above is the common problem in the conventional terminal systems employing spring force to connect the cable. Various kinds of terminal systems, except the above example have been proposed, however, there is no invention which essentially solved this problem.

OBJECTS OF THE INVENTION

The main object of the present invention is, in providing this kind of easy connection type terminal system, in order to send the sufficiently large current to a general electric instruments used in home, to expand its use in which the conventional systems were limited to the use for small electricity such as an electric stand.

Another object of the present invention is to simplify each part in spite of the structure enduring the large current described above, and in spite of the purpose of increasing current capacity. An added part is not employed, since the terminal is integrated as one part per one electric circuit.

In the present invention designed to attain these objects, a piece of metallic spring material is employed, and the portion which exclusively takes charge of mechanical connection and the portion which exclusively takes charge of electric contact are independently formed on the spring material, therefore, each portion does not inhibit the other function. In other words, the portion which takes charge of the mechanical connection does not inhibit the portion which takes charge of electric contact, and the portion which takes charge of electric contact does not inhibit the portion which takes charge of mechanical connection. Therefore, each portion can fully exert its function, and the object is attained. Through this method, the conventional problem, when the function of mechanical connection in the conventional terminal system is improved, the electric capacity is decreased, and when the electric capacity is improved then the function of mechanical connection is decreased, has been solved.

DETAILED DESCRIPTION OF THE INVENTION

Figure 1:
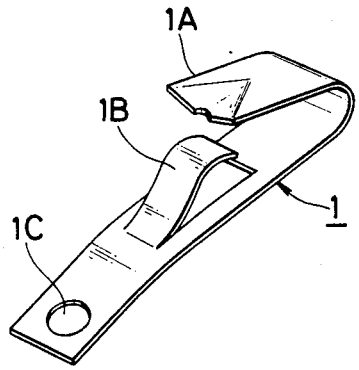
FIG. 1 shows the retaining portion being main portion of the first embodiment of the present invention, viewed from an oblique point.
Figure 2:
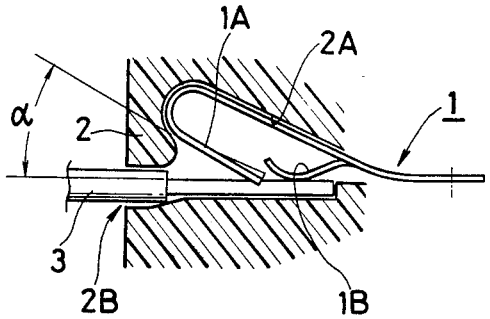
FIG. 2 is a cross sectional drawing showing the first embodiment of the present invention, assembled in a case.

More detailed description of the present invention, using several embodiments, is written in the following. FIG. 1 and FIG. 2 are for the first embodiment of the present invention. The part shown in FIG. 1 is the retaining portion 1. This retaining portion 1 is formed using a material, having superiority in spring function and in the electric conductivity, such as phosphor bronze and brass. At the end, the connecting portion 1A, which exclusively takes charge of mechanical connection and has a suitable shape in fixing the cable, for example, a tooth portion to bite the cable, also has a moderate angle with the cable when it is assembled, and further to strengthen the spring function, is bent with a moderate radius. At the nearly middle position of the above retaining portion 1, the electric contact portion 1B, exclusively taking charge of electric contact, is formed to have a suitable shape for electric contact, in other words, with a contact area being as large as possible.

The end portion 1C, located at the opposite side of said connecting portion 1A of said retaining portion 1, is used, when the terminal system of the present invention is applied to various electrical instruments, and the shape of 1C can be changed in accordance with the object of use.

FIG. 2 shows the condition where the above described retaining portion 1 is attached to the case 2, as apparent in an drawing, by providing the empty space, shown with the enclosing portion 2A suitably arranged, in the case 2, above connecting portion 1A and above described electric contact portion 1B arranged at the suitable position. In this case, when the cable 3 is inserted from cable inserting hole 2B of case 2, said connecting portion 1A and said electric contact portion 1B are deformed, as shown in the drawing, and receive the insertion of said cable 3 without generating large mechanical resistance. And when the insertion of cable 3 is finished, if the load to pull said cable 3 is applied, due to the interaction of the angle $\alpha$ with said cable 3 and the spring pressure force, said connecting portion 1A comes to bite said cable 3 more and more, generating a large resistance against the pulling load. This effect has been confirmed to be sufficient for practical use by the inventor even in the case where the thickness of said retaining portion 1 is very thin.

And at said electric contact portion 1B, the resistance forces against pulling load and inserting load are same.

Figure 3:
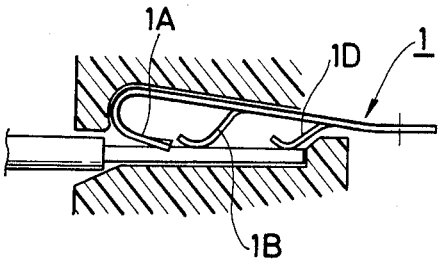
FIG. 3 is a cross sectional drawing of the second embodiment of the present invention.

FIG. 3 shows the second embodiment of the present invention, and the object of it is to provide the terminal system of the present invention which endures larger electric current, with an expansion of the contact area. For this purpose, electric contact portion 1D, having the same structure as electric contact portion 1B explained in the above described FIG. 1 and FIG. 2, is added, and the contact area becomes two times and the allowable electric current also becomes two times through this means.

The above described explanation is a basic description in the present invention, and the applicable range is very wide. The following several concrete embodiments are representative examples.

Figure 4:
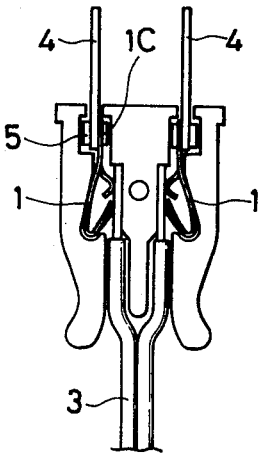
FIG. 4 is a cross sectional drawing of the first embodiment applied to plug.

FIG. 4 shows the third embodiment of the present invention. This embodiment is the case wherein the first embodiment is applied to the plug. As will be apparent from the drawing, at end portion 1C of said retaining portion 1, the plugging blade 4 is fixed with rivet 5, and further, the case 2 is formed so as to fit in a plug shape. With the above integration, the connection between said plug and said cable can be possible, through easily inserting the ends of parallel cord 3 where the cover is removed.

Figure 5:
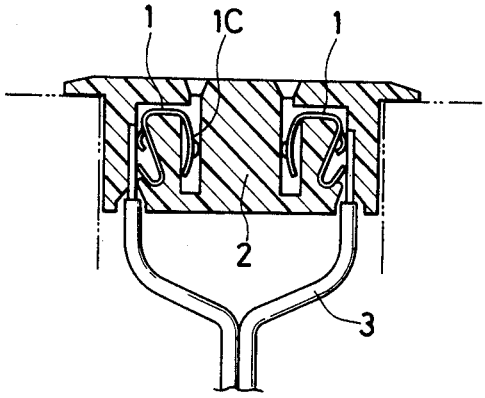
FIG. 5 is a cross sectional drawing of the first embodiment applied to plug receptacle.
Figure 6:
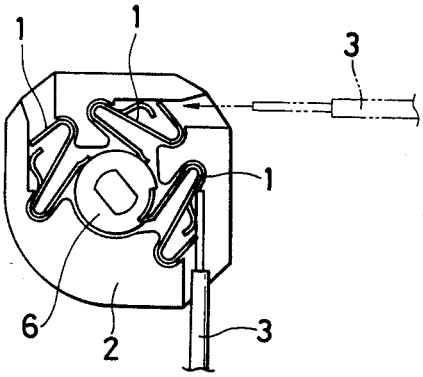
FIG. 6 is a cross sectional drawing of the first embodiment applied to rotary switch.

FIG. 5 shows the fourth embodiment of the present invention, and this embodiment is the case wherein the first embodiment is applied to plug receptacle. As same as in the previous example, the end portion 1C of said retaining portion 1 is formed to have a suitable shape in connecting with plugging blade 4 shown in the third embodiment, and is enclosed in case 2 formed so as to fit in the plug receptacle, and the effect of it is the same as previously mentioned.

Figure 7:
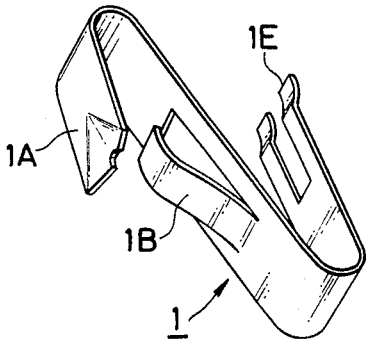
FIG. 7 is a drawing showing the main portion in FIG. 6, viewed from an oblique point.
Figure 8B:
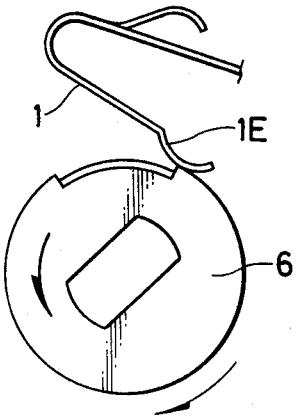
FIGS. 8*a* to 8*c* are drawings describing the function and detail.
Figure 8A:
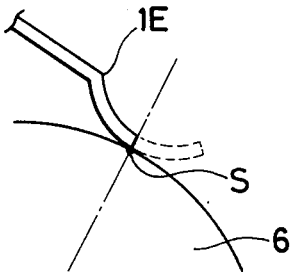
Figure 8C:
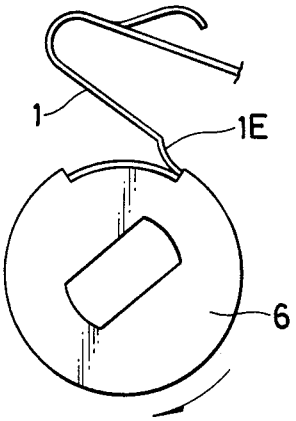
Figure 9:
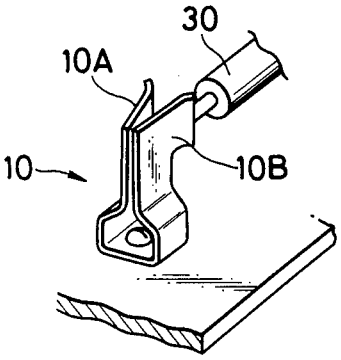
FIG. 9 and FIG. 10 are drawings viewed from an oblique point, both showing conventional examples.
Figure 10:
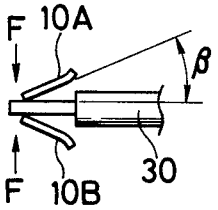

FIG. 6 to FIG. 8*c* show the fifth embodiment of the present invention, and this embodiment is the case wherein the first embodiment is applied to the rotary switch. As will be apparent from the drawing of FIG. 6, end portion 1C of said retaining portion 1 is formed to have a brush shape suitable in sliding on rotary terminal 6 of the rotary switch. The more detailed explanation of this condition is shown in FIG. 7. In the present embodiment, the supplemental invention based on the principle of the present invention is introduced. In particularly explaining brush portion 1E, brush portion 1E of the present invention is cut at the position of contact point S, while the usual brush has a nearly symmetrical circular arc portion with a center axis locating on contact point S of said rotary terminal 6. Through this means, as same as in the first embodiment described above, the rotary can be rotated with a light load in a circular direction, and it can be rotated with slightly heavy load in a reverse direction. Therefore, it can be prevented that the conventional system has a possibility to be rotated in the normal direction or the reverse direction, when rotary terminal 6 is on the dead point. And further, as shown in FIG. 8*b* and FIG. 8*c*, the ratchet function can be provided, in this case, the reverse rotation is perfectly prevented. In order to make this mechanism more effective and to ensure the contact, as shown in FIG. 7, the above described brush 1E divided into two pieces.

In the embodiments from third to fifth, all are the application of the first embodiment. It is manifest, of course, that these all embodiments can be applied to the second embodiment, it is needless to say also that these embodiments can be applied to other electric instruments.

We claim:

1. A terminal used for connecting a cable to an electric wiring system comprising:

(a) a case communicating with an electric wiring system and including an inner chamber having a cable hole leading to the exterior and an inner wiring hole leading to a source of electricity;

(b) a unitary spring biased conducting plate seated in said case intemediate said cable hole and said wiring hole, further including:

(i) a curvate middle portion seated against the top of said chamber;

(ii) a cable connecting portion extending downwardly and inclined inwardly of said cable hole so as to lockingly engage a cable inserted in said cable hole;

(iii) an electrical contact portion extending inwardly of said wiring system hole and towards said cable connecting portion so as to engage a cable inserted in said cable hole; and (iv) an end portion extending from said electrica contact portion through said wiring hole to a source of electricity.

2. A terminal used for connecting a cable to an electric wiring system as in claim 1, wherein said case is conformed as a plug with two inner chambers and further including two plugging blades extending discretely into said inner chambers, each blade supporting a unitary spring biased conducting plate supported within each of said inner chambers.

3. A push-in terminal as in claim 2, wherein said plug is conformed to retain plugging blades therein.

4. A terminal used for connecting a cable to an electric wiring system as in claim 1, wherein said electrical contact portion is defined in two pieces as a brush assembly.

5. A push-in terminal system used for connecting a cable to an electric wiring system as in claim 4, wherein both pieces of said brush assembly are conformed as a rotary switch to engage a rotary terminal.

* * * * *